United States Patent [19]

Krebs

[11] 4,262,607

[45] Apr. 21, 1981

[54] SAFETY DEPOSIT BOX

[75] Inventor: Murray A. Krebs, Willowdale, Canada

[73] Assignee: Chubb Industries Limited, E. Brampton, Canada

[21] Appl. No.: 40,486

[22] Filed: May 21, 1979

[51] Int. Cl.[3] ..... B65D 51/04; A45C 1/12

[52] U.S. Cl. ..... 109/58; 109/45; 220/315

[58] Field of Search ..... 109/58, 45, 56, 57, 109/64, 66; 220/334, 324, 326

[56] References Cited

U.S. PATENT DOCUMENTS

| | | | |
|---|---|---|---|
| 2,356,804 | 8/1944 | Whiting | 109/57 |
| 3,592,354 | 7/1971 | Nielsen | 220/334 |
| 3,595,433 | 7/1971 | Jones | 220/324 |
| 3,966,084 | 6/1976 | Box | 220/326 |

*Primary Examiner*—Reinaldo P. Machado
*Attorney, Agent, or Firm*—Ridout & Maybee

[57] ABSTRACT

A safety deposit box of all plastic construction has a tray component and a cover comprising a fixed lid and a hinged lid hingedly connected thereto. The hinge is a plastic molding having a pair of resilient tongues engageable with retainers on the undersides of the lids, and having a flexible medial portion which defines a transverse hinge axis. The hinged lid is held in the closed position by an all plastic releasable latch.

4 Claims, 6 Drawing Figures

10
11
12
13
15
16
17
18
19
20
21
22
23
24
25
26
27
28
29
30
35
36
3
4
6
~10~
~12~
~13~

SAFETY DEPOSIT BOX

This invention relates to safety deposit boxes, or removable bond boxes, of the type having a hinged lid or top and used to store personal valuables for storage in vaults or the like.

Existing safety deposit boxes are of metallic construction, which gives rise to a number of disadvantages. First, the hinge for the lid is commonly of a sheet metal construction or is a standard butt hinge, the hinge either protruding inwards into the box and so reducing its storage capacity, or protruding outwards and so reducing the size of box which might be placed in a given size compartment of a vault in which such boxes are nested. Second, most safety deposit boxes make no provision for sealing, and those that do make such provision require unsightly metal parts. Third, when decorative patterns are applied these are usually applied as decorative labels which tend to wear off.

The present invention overcomes the afore-mentioned disadvantages by providing an all plastic box construction which permits the use of a hinge construction requiring less space than a conventional hinge, which makes provision for sealing when required without the need for unsightly parts, and which permits the application of decorative patterns by a hot stamping process, thereby allowing the patterns to be applied below the surface where they are not subject to wear.

Thus, a safety deposit box in accordance with the present invention, and consisting of molded plastic components, comprises a tray component defining an open-topped receptacle having front and rear end walls and a pair of longitudinal side walls providing a peripheral rim, and first and second complementary lid components defining a cover which is coextensive with the receptacle opening and provides a peripheral flange overlying the walls of the receptacle. The first lid component is sealed to the rim, for example by ultrasonic welding, so as permanently to cover a rear portion of the receptacle opening, the second lid component being hingedly connected to it about a transverse axis. The hinge itself is a one-piece molding of resilient plastics material having a flexible medial portion defining said transverse hinge axis and forwardly and rearwardly directed locking tongues which are engaged and retained by respective retaining members secured to the undersides of the lid components. The retaining members are preferably formed as flat apertured strips which define slots with the undersides of the lids, the tongues of the hinge engaging in these slots and being formed with studs which engage in the apertures with a snap action. The second lid component is normally held in the closed position by a releasable latch cooperating with the front end wall of the tray component and a complementary portion of the second lid component.

In order that the invention may be understood more readily, one embodiment thereof will now be described by way of example with reference to the accompanying drawings in which.

Figures 1, 2:
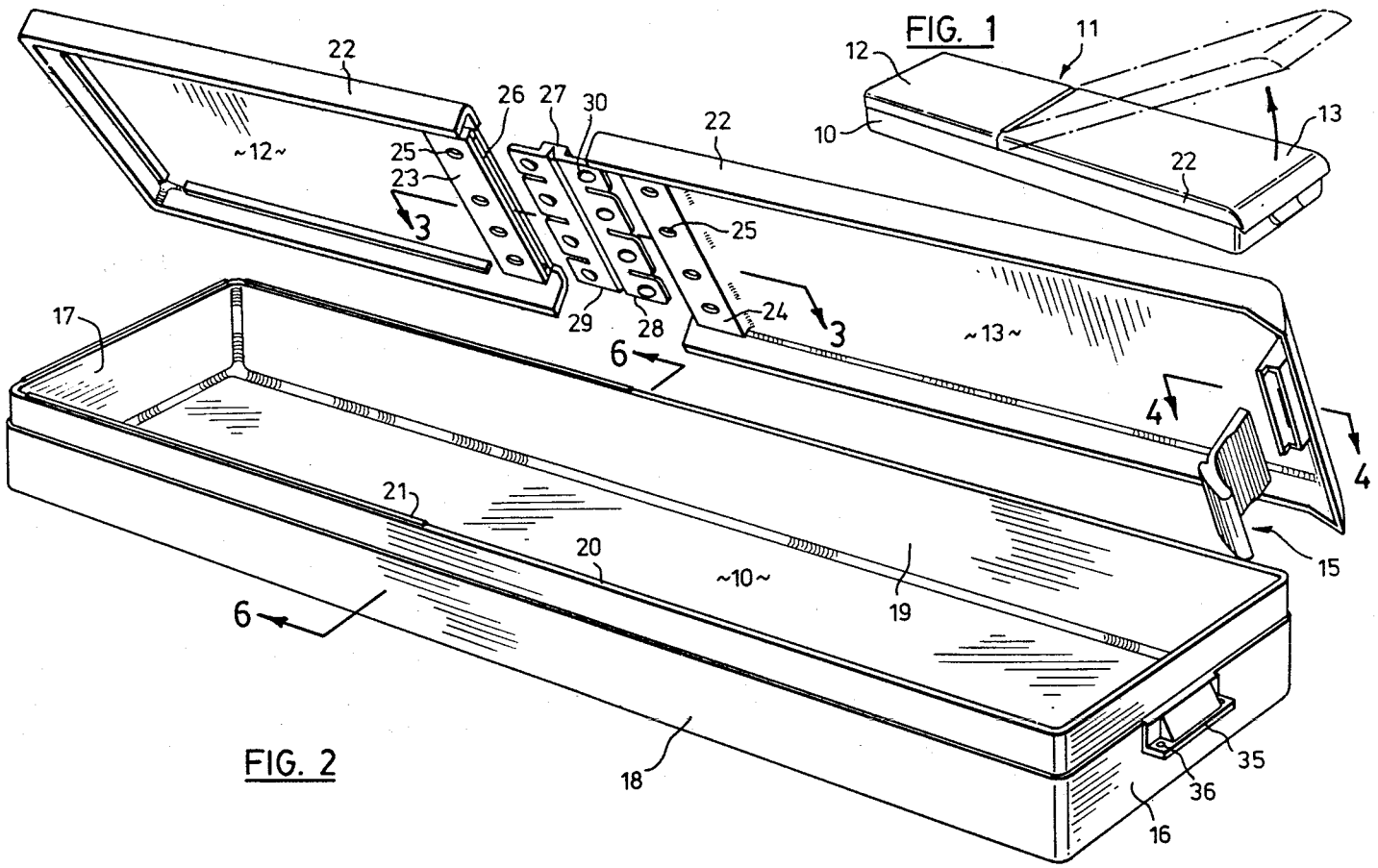
FIG. 1 is a perspective view of a safety deposit box according to the invention, the lid being closed but the open position of the lid being shown by chain-dotted lines.
FIG. 2 is an exploded view of the box, the five components of the box being shown separately.

Referring to FIG. 1, the safety deposit box comprises an elongated rectangular tray 10 with a cover 11, the rear portion 12 of the cover being permanently sealed to the rim of the tray opening, as by ultrasonic welding, and the front portion 13 serving as a hinged lid.

As shown in FIG. 2, the box is made up of five molded plastic components, namely a tray component 10, a first lid component 12 which forms the rear portion of the cover, a second lid component 13 which forms the front portion of the cover, a hinge component 14, and a latch component 15. The tray component 10 defines an open-topped receptacle for receiving the articles to be stored, and is bounded by four upstanding walls, namely front and rear end walls 16, 17 and a pair of longitudinal side walls 18, 19. These walls define a peripheral rim 20. Integral beads 21 are formed along the rim at the rear end wall and rear portions of the side walls. These beads serves as energy directing means to facilitate welding of the lid component 12 to the rim during manufacture. As illustrated, the lid components 12, 13 are of complementary shape to form the composite cover 11, which has a peripheral flange 22 extending beyond the rim of the tray component 10 and overlying its side and end walls.

Figure 3:
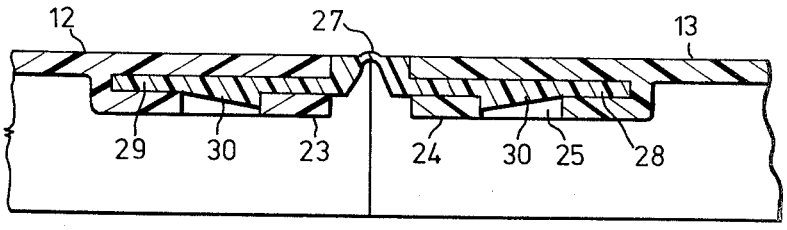
FIG. 3 is a section on line 3—3 in FIG. 2 showing the hinge construction.

A pair of hinge retaining members 23, 24 are secured to, and preferably formed integrally with, the undersides of the lid components 12, 13 adjacent their complementary edges. Each of these hinge retaining members is formed as a flat strip providing a row of apertures 25. The flat strip is spaced from the underside of the lid component within the depth of the peripheral flange 22 and defines a slot 26 with the underside. The hinge component 14, as also shown in FIG. 3, is a one-piece molding of resilient plastic material providing a flexible medial portion 27. This portion is configured to define a transverse hinge axis. The hinge component 14 also provides a row of forwardly directed tongues 28 and a row of rearwardly directed tongues 29, these tongues being formed with circular bosses or studs 30 positioned to engage in the apertures 25. The studs 30 are of wedge-shaped section so that the tongues 28 can readily be inserted into the slots 26, the studs 30 engaging in the apertures 25 with a snap action to retain the tongues in the slots.

Figure 4:
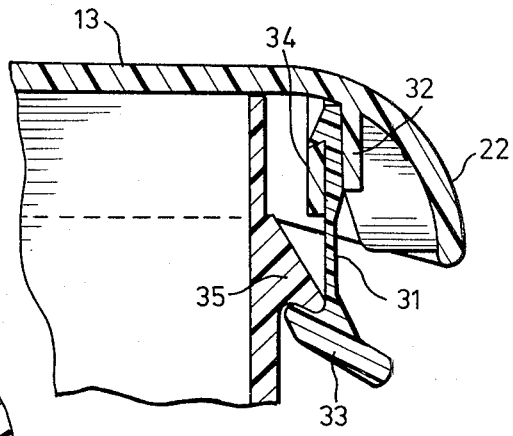
FIG. 4 is a section on line 4—4 in FIG. 2 showing the latch construction.
Figure 5:
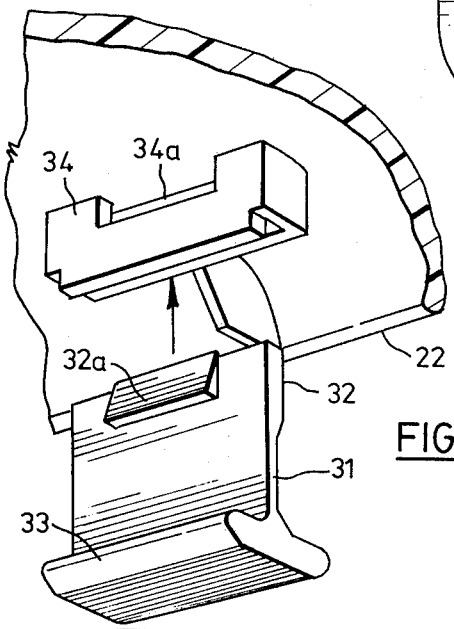
FIG. 5 is another view of the latch.
Figure 6:
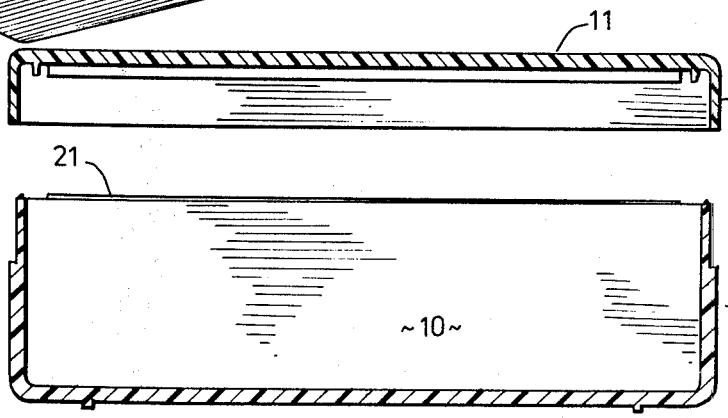
FIG. 6 is a section on line 6—6 in FIG. 2.

The latch component 15 is a one-piece molding of flexible resilient plastic material providing a flexible strip portion 31, a barbed spigot portion 32, and an enlarged section 33 at its lower edge forming a latch projection. The underside of the hinged lid component 13 is formed with an integral downwardly extending wall portion 34, positioned to lie between the rim 12 of the front end wall 16 of the tray and the front peripheral flange 12 of the lid component. This wall portion 34 has a transverse slot with an interior ledge engageable with the barb of the spigot 32, as illustrated in FIG. 4. The latch is attached to the lid by inserting the barbed spigot portion 32 into the transverse slot so that the barb **32*a* (FIG. 5) snaps behind the ledge 34*a* (FIG. 5), the latch thus being locked in position. The front wall 16 of the tray component has a latch-engaging projection 35 which is engageable with the latch projection 33, as shown in FIG. 4**, for releasably latching the lid in the closed position.

To provide for sealing of the safety deposit box, should this be required, the projection 35 is formed with a pair of holes 36 which are aligned with a pair of blind holes (not shown) on the underside of the lid. The visual integrity of the surface of the lid is thus preserved until sealing of the box is required. To seal the box it is only necessary to push a wire or needle through the blind holes, thus forming holes to receive a sealing wire which is also passed through the holes 36.

The tray component 10 and lid components 12, 13 are preferably of an impact resistant plastic material such as polycarbonate resin. The hinge component 14 is preferably of polypropylene, and the latch component 15 may be of nylon.

What I claim is:

1. A safety deposit box consisting of molded plastic components, namely:

a tray component defining an open-topped receptacle having front and rear end walls and a pair of longitudinal side walls providing a peripheral rim, first and second complementary lid components defining a cover coextensive with the receptacle opening and providing a peripheral flange overlying said end and side walls, the first lid component being sealed to the rim and permanently covering a rear portion of said opening, the second lid component being hingedly connected to the first lid component about a transverse hinge axis for closing a front portion of said opening, a hinge component comprising a one-piece molding of resilient plastics material having a flexible medial portion defining said transverse hinge axis and forwardly and rearwardly directed locking tongues, first and second hinge retaining members integrally formed respectively with said lid components, the locking tongues being respectively engaged and retained by said members, and releasable latching means cooperating with said front end wall and a complementary portion of the second lid component for releasably holding the second lid component in the closed position, wherein each of the hinge retaining members is formed as a flat strip defining a slot with the underside of the lid to which it is secured, each of the hinge retaining members being formed with an abutment edge, the tongues of the hinge component being engageable in said slots and being formed with integral studs engageable with a snap action with said abutment edges to be retaining thereby.

2. A safety deposit box according to claim 1, wherein the first lid component is sealed to said peripheral rim by ultrasonic welding.

3. A safety deposit box according to claim 1, wherein said releasable latching means comprises a one-piece molding of flexible, resilient plastic material providing a latch projection connected by a flexible strip portion to a barbed spigot portion, the underside of the second lid component providing a slotted retaining member for receiving and retaining said barbed spigot projection, and the front wall of the tray component providing a latch-engaging projection engageable with said latch projection for holding the second lid component in the closed position.

4. A safety deposit box consisting of molded plastic components, namely:

a tray component defining an open-topped receptacle having front and rear end walls and a pair of longitudinal side walls providing a peripheral rim, first and second complementary lid components defining a cover coextensive with the receptacle opening and providing a peripheral flange overlying said end and side walls, the first lid component being sealed to the rim and permanently covering a rear portion of said opening, the second lid component being hingedly connected to the first lid component about a transverse hinge axis for closing a front portion of said opening, a hinge component comprising a one-piece molding of resilient plastics material having a flexible medial portion defining said tranverse hinge axis and forwardly and rearwardly directed locking tongues, first and second hinge retaining members integrally formed respectively with said lid components, the locking tongues being respectively engaged and retained by said members, and releasable latching means cooperating with said front end wall and a complementary portion of the second lid component for releasably holding the second lid component in the closed position, wherein each of the hinge retaining members is formed as a flat apertured strip defining a slot with the underside of the lid to which it is secured, each aperture providing an abutment edge, the tongues of the hinge component being engageable in said slots and being formed with integral studs positioned to engage in said apertures with a snap action for retaining the tongues in said slots.

* * * * *